United States Patent [19]

Küttner et al.

[11] Patent Number: 4,688,535

[45] Date of Patent: Aug. 25, 1987

[54] APPARATUS FOR INFLUENCING CONTROL QUANTITIES OF AN INTERNAL COMBUSTION ENGINE

[75] Inventors: Thomas Küttner, Stuttgart; Wolf Wessel, Oberriexingen, both of Fed. Rep. of Germany

[73] Assignee: Robert Bosch GmbH, Gerlingen-Schillerhohe, Fed. Rep. of Germany

[21] Appl. No.: 657,212

[22] Filed: Oct. 3, 1984

[30] Foreign Application Priority Data

Oct. 4, 1983 [DE] Fed. Rep. of Germany ..... 3336028

[51] Int. Cl.[4] ..... F02D 41/04; F02P 5/145

[52] U.S. Cl. ..... 123/436; 123/419

[58] Field of Search ..... 123/436, 419

[56] References Cited

U.S. PATENT DOCUMENTS

| | | | |
|---|---|---|---|
| 4,178,891 | 12/1979 | Latsch et al. | 123/419 |
| 4,357,662 | 11/1982 | Schira et al. | 123/436 |
| 4,366,793 | 1/1983 | Coles | 123/436 |
| 4,475,511 | 10/1984 | Johnson et al. | 123/436 |
| 4,495,920 | 1/1985 | Matsumura et al. | 123/436 |

*Primary Examiner*—Andrew M. Dolinar

*Attorney, Agent, or Firm*—Walter Ottesen

[57] ABSTRACT

The invention is directed to an apparatus for influencing control quantities of an internal combustion engine by means of which vibrations of the entire vehicle in the lower engine speed range, particularly at idling, are to be eliminated. This is accomplished by allocating to each cylinder a regulating unit which regulates the control quantities influencing the respective cylinder, such as fuel metering, exhaust gas recirculation, start of injection, duration of injection, air/fuel ratio, ignition time point, et cetera, for the smoothest possible running condition.

13 Claims, 6 Drawing Figures

APPARATUS FOR INFLUENCING CONTROL QUANTITIES OF AN INTERNAL COMBUSTION ENGINE

BACKGROUND OF THE INVENTION

In motor vehicles running in the lower speed range, particularly at idling, the entire vehicle is often subject to low-frequency vibrations. These vibrations are in the range of between 1 and 5 Hz.

The reason for these vibrations lies in the series production of the fuel-injection equipment. The injection components are manufactured to tolerances causing different quantities of injected fuel per cylinder. These differences in fuel quantity result in rapid torque changes which excite the vibratory composite of engine and chassis. Thus, the vibrations are an unavoidable consequence of manufacturing tolerances.

These low-frequency vibrations may be dampened, for example, by correcting the amounts of fuel to be injected into the individual cylinders. Such an apparatus for dampening the vibrations includes, for example, a regulator which, in dependence on rapid torque changes, varies a predetermined desired fuel value in such a manner to keep these torque changes at a minimum possible level.

SUMMARY OF THE INVENTION

It is the object of the invention to provide an apparatus for influencing control quantities of an internal combustion engine to correct the amounts of fuel to be injected into the individual cylinders fast, accurately, reliably and with the objective to have each cylinder deliver the same torque, thereby providing a smooth running condition of the engine. This is accomplished by providing a smooth-running regulating arrangement wherein each cylinder is provided with a regulating unit of its own.

BRIEF DESCRIPTION OF THE DRAWINGS

The invention will now be described in more detail in the following with reference to the drawing wherein.

DESCRIPTION OF THE PREFERRED EMBODIMENTS OF THE INVENTION

Figure 1:
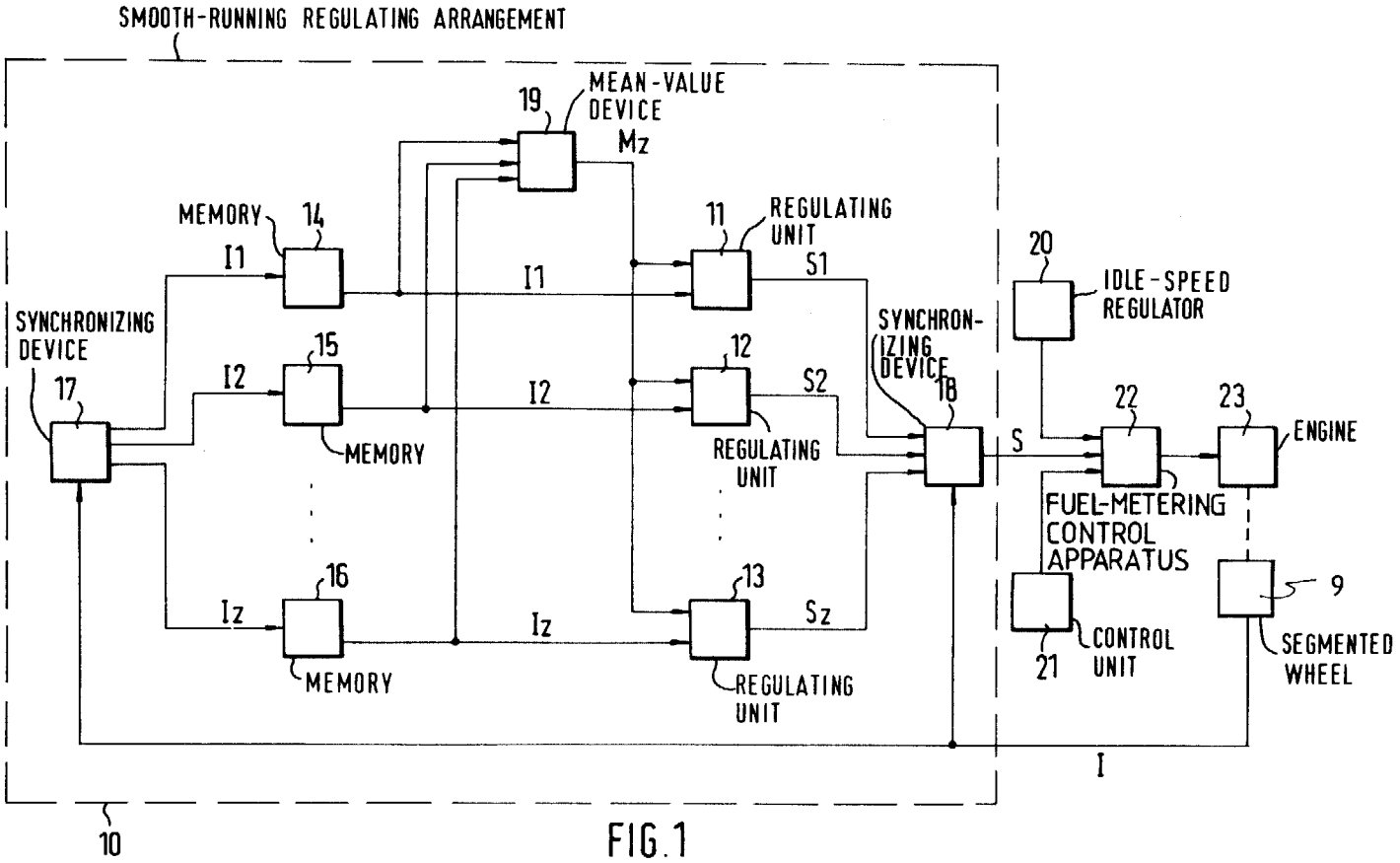
FIG. 1 is a block diagram showing a smooth-running regulating arrangement for an internal combustion engine.

Referring now to FIG. 1, reference numeral 10 identifies a smooth-running regulating arrangement for an internal combustion engine. The regulating arrangement includes a number z regulating units 11, 12 and 13, with z denoting the number of cylinders that the internal combustion engine has. Further, smooth-running regulating arrangement 10 includes z memory storage units 14, 15 and 16, two synchronizing devices 17 and 18, as well as a device 19 for forming a mean value. For a better understanding of the smooth-running regulating arrangement 10, FIG. 1 also shows an idle-speed regulator 20, a control unit 21 which is dependent on the position of the accelerator pedal, a fuel-metering apparatus 22, and the internal combustion engine 23.

The z regulating units 11, 12 and 13 are connected to their associated z memory storage units 14, 15 and 16, respectively, and to the output of mean-value device 19. Device 19 has applied to its input the output signals from all z memory storage units 14 to 16. The inputs of the z memory storage units 14 to 16 are connected to synchronizing device 17; whereas, the outputs of the z regulating units 11 to 13 are connected to synchronizing device 18. The two synchronizing devices 17 and 18 are activated by a signal dependent on the internal combustion engine 23. Internal combustion engine 23 is connected to fuel-metering control apparatus 22 which, in turn, is connected to synchronizing device 18, idle-speed regulator 20 and accelerator-dependent control unit 21.

Figure 2:
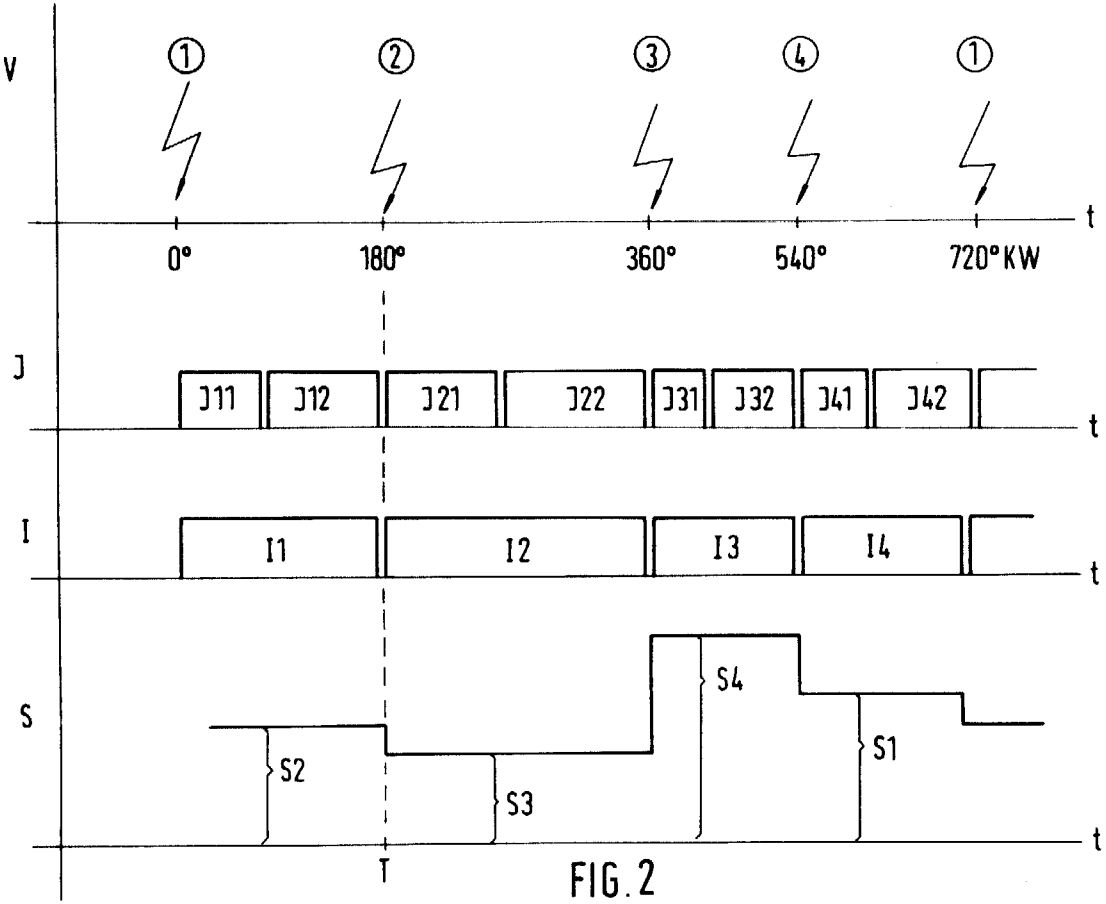
FIG. 2 is a timing diagram of the smooth-running regulating arrangement of FIG. 1.

The mode of operation of the smooth-running regulating arrangement of FIG. 1 can best be described with reference to the timing diagram of FIG. 2. FIG. 2 illustrates the timing diagram of a four-cylinder internal combustion engine. It shows the time span covering two crankshaft revolutions, that is, a crank angle of 720° . In this time span, each one of the four cylinders has experienced one combustion.

In this timing diagram, I and J identify two actual-value signals that are generated by means of a segmented wheel 9. This wheel 9 is connected with the crankshaft and has four segments symmetrically spaced over its periphery. Each pulse of the actual-value signal J corresponds to one wheel segment. The length of each pulse of actual-value signal J corresponds to the length of time a segment of the wheel takes to traverse an imaginary plane perpendicular to the segmented wheel 9. Since four segments of the wheel traverse the imaginary plane during one crankshaft revolution, yet with only two combustions occurring in the cylinders during this time, it is exactly two segments of the wheel that traverse the imaginary plane perpendicular to the wheel between two combustions. Accordingly, the time span between two combustions is subdivided into two time periods by means of these two wheel segments.

In view of the symmetrical configuration of the segmented wheel and considering that the crank angle velocity immediately following a combustion is always somewhat higher than immediately prior to a combustion, these two time periods, for example, J21 and J22, are always of different magnitude. Therefore, the shorter one of the two time periods, for example, J21, will always indicate that a combustion has occurred; whereas, the longer one of the two time periods, for example, J22, will indicate that a combustion is about to occur.

After a one-time adjustment of the segmented wheel on the crankshaft, the actual-value signal J thus permits an accurate determination of the simulated combustion time points V of the individual cylinders, which are also referred to as synchronizing signals. The timing diagram of FIG. 2 shows the combustion time points V of the individual cylinders and their relationship to the actual-value signal J.

The determination of the combustion time points V from actual-value signal J is performed in the two synchronizing devices 17 and 18 of FIG. 1. By means of the simulated combustion time points V, synchronizing device 17 directs the actual values I1, I2 and Iz to their associated memory storage units 14, 15 and 16, respectively; whereby, these actual values I1, I2 to Iz are likewise generated by synchronizing device 17 with the aid of actual-value signal J. Actual values I1, I2 to Iz reflect the durations of time between two combustion time points, as illustrated in FIG. 2. Equally, synchronizing device 18 determines, with the aid of actual-value signal J, the simulated combustion time points V and switches the correcting quantities S1, S2 and Sz formed by regulating units 11, 12 and 13, respectively, to fuel-metering apparatus 22 as correcting signal S.

Correcting signal S is illustrated in the timing diagram of FIG. 2. It is made up of correcting quantities S1, S2 to Sz of the individual cylinders, these quantities being generated by the regulating units corresponding thereto. Thus, for example, correcting quantity S1 is produced by regulating unit 11 from actual value I1 buffered in memory storage unit 14 and a mean value Mz. Mean value Mz is formed by mean-value device 19 from all buffered actual values I1, I2 to Iz.

If, for example, the internal combustion engine is at time T as illustrated in the timing diagram of FIG. 2: first, a combustion occurs in cylinder 2 in this instant; second, synchronizing device 17 delivers actual value I1, that is, the duration of time between the combustion in cylinder 1 and the combustion in cylinder 2, to memory storage unit 14; and, third, synchronizing device 18 directs correcting quantity S3 to fuel-metering apparatus 22 for the next combustion in cylinder 3. This switching of correcting quantity S3 takes place a short time after T to enable the associated regulating unit to adjust this new correcting quantity. As a result, this new correcting quantity is dependent on all preceding actual values.

Thus, the entire smooth-running regulating arrangement 10 produces from an actual-value signal I obtained by means of a segmented wheel, a correcting signal S for input into the fuel-metering apparatus 22. Where applicable, further inputs from an idle-speed regulator 20 and/or an accelerator-dependent control unit 21, for example, may also influence the apparatus 22. Fuel metering apparatus 22 then uses these input signals for determination of, for example, the quantity of fuel to be injected into the internal combustion engine 23.

Since the regulating units 11 to 13 and the idle-speed regulator 20 may be integral-action regulators, for example, the case may occur that these two integral-action components operate in opposition to each other. To avoid this, it is necessary for the smooth-running regulating arrangement 10 to be incorporated into the entire injection system of the internal combustion engine. This is possible, for example, because the smooth-running regulating arrangement 10 can only dynamically influence the entire injection system. For this dynamic influence, it is then necessary for the sum of the correcting quantities S1 to Sz to be equal to zero, that is, the mean-fuel quantity which, as a result of the smooth-running regulation, is delivered to the internal combustion engine as a decrement or as an increment, must be zero taken over z injections. This requirement for incorporation of the smooth-running regulating arrangement 10 into the entire injection system may be met, for example, by means of one of the modifications of the smooth-running regulating arrangement shown in FIGS. 3 to 5.

Figure 3:
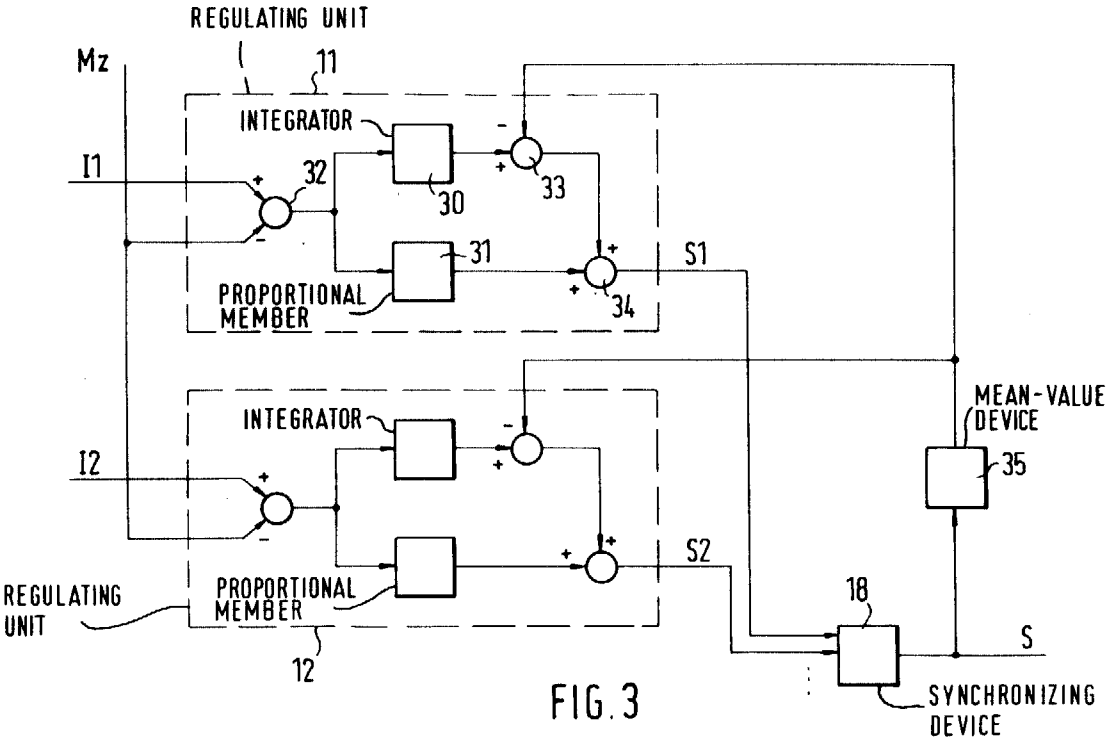
FIGS. 3 to 5 are diagrams showing various possibilities to incorporate the smooth-running regulating arrangement into an existing fuel-metering appartus; and, FIG. 6 shows the blocks supplied by the smooth-running regulating arrangement of FIG. 1 wherein these blocks are supplemented with a multiplier and a threshold to make the apparatus according to the invention effective only in a definite, pre-supposable rotational engine speed range and to be controlled in the transition ranges bounding on this range so as to avoid a jump-like climb or drop of the correcting signal.

FIG. 3 shows the block diagram of a part of the smooth-running regulating arrangement. In this example, the smooth-running regulating arrangement is incorporated into the entire injection system by subtracting the mean value of correcting signal S from the output signals of the integrators of the regulating units corresponding to the individual cylinders. In this example, regulating unit 11 includes an integrator 30, a proportional member 31, two subtracting points 32 and 33, and an adding point 34.

The input signals I1 and Mz applied to regulating unit 11 first are combined at subtracting point 32. The output signal of subtracting point 32 is fed to integrator 30 and proportional member 31. The output signal of proportional member 31 is connected to adding point 34 which also has the output signal of subtracting point 33 applied to its input. This output signal of subtracting point 33 is generated from the output signal of the integrator 30 on the one hand and from the mean value of correcting signal S on the other hand. The output signal of adding point 34 represents the correcting quantity S1 which is supplied to synchronizing device 18. The output signal of synchronizing device 18 is the correcting signal S which is fed to a device 35 for forming a mean value. The output signal of device 35 is indicative of the mean value of correcting signal S. The mean value device 35 may be a low-pass filter, for example.

As indicated in FIG. 3, correcting signal S is not only fed back to regulating unit 11 but also to regulating units 12 and 13 corresponding to the other cylinders. Feeding correcting signal S back to all regulating units 11 to 13 of smooth-running regulating arrangement 10 causes the mean value of the correcting signal to be equal to zero over z combustions.

Figure 4:
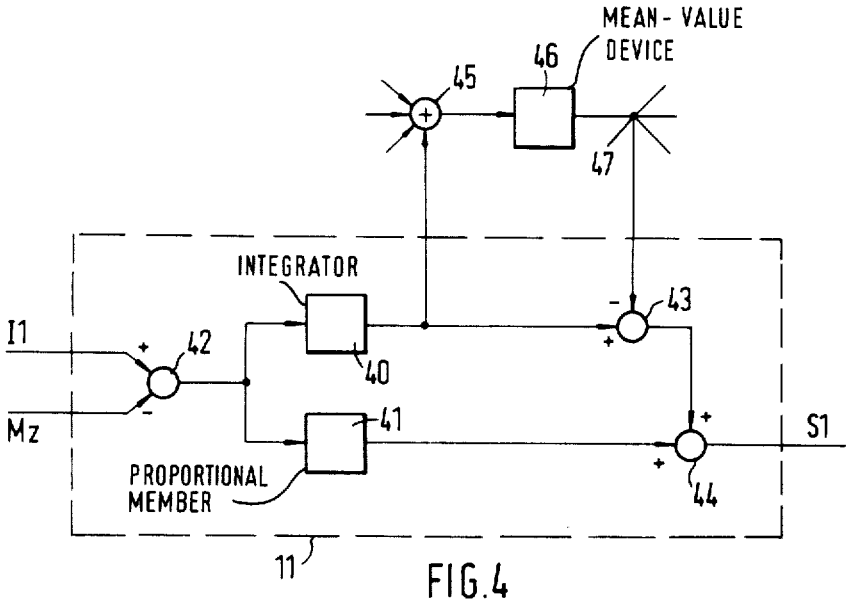

In FIG. 4, the incorporation of the smooth-running regulating arrangement into the entire injection system is accomplished by subtracting the mean value of the integrators of the regulating units corresponding to the individual cylinders from the output signals of these integrators of the individual regulating units.

In this embodiment, regulating unit 11 includes an integrator 40, a proportional member 41, two subtracting points 42 and 43 and an adding point 44. Input signals I1 and Mz applied to regulating unit 11 are combined in subtracting point 42. The output signal of subtracting point 42 is fed to integrator 40 and proportional member 41. The output signal of integrator 40 is then connected to a summing point 45 receiving in addition the output signals of the integrators of the regulating units corresponding to the other cylinders. The output signal of summing point 45 is applied to a mean-value device 46 for forming a mean-value signal. The output signal of mean-value device 46 is connected to connecting node 47. Node 47 is connected to all regulating units corresponding to the individual cylinders.

In the regulating unit 11 illustrated in FIG. 4, connecting node 47 is connected to subtracting point 43 which has also the output signal of the integrator 40 applied to it. Adding point 44 is connected to the output signal of subtracting point 43 on the one hand and to the output signal of proportional member 41 on the other hand. The output signal of adding point 44 represents the correcting quantity S1. By the formation of a mean value from all the output signals of the integrators of the regulating units corresponding to the individual cylinders and by the subtraction of this mean value from these output signals, the requirement for incorporation of the smooth-running regulating arrangement into the entire injection system is satisfied.

Figure 5:
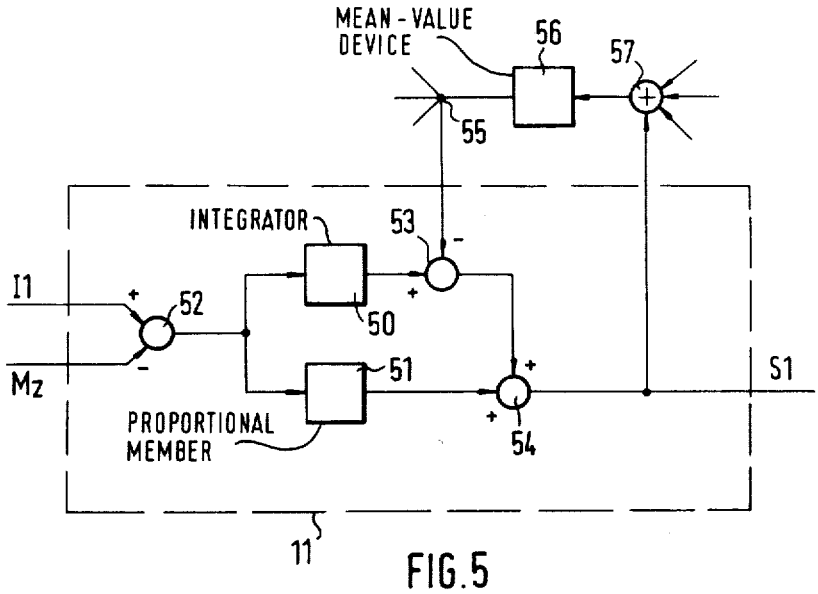

FIG. 5 shows another embodiment for incorporating the smooth-running regulating arrangement into the entire injection system. In this embodiment, the mean value of the correcting quantities of the regulating units corresponding to the individual cylinders is subtracted from the output signal of the integrators of these regulating units. In this arrangement, regulating unit 11 includes, for example, an integrator 50, a proportional member 51, two subtracting points 52 and 53, and an adding point 54. Input signals I1 and Mz applied to regulating unit 11 are combined in subtracting point 52. The output signal of subtracting point 52 is then fed to integrator 50 and proportional member 51. The output signal of integrator 50 is connected to subtracting point 53, and the output signal of the proportional member 51 is connected to adding point 54.

Further, adding point 54 has applied to its input the output signal of subtracting point 53. The output signal of adding point 54 represents the correcting quantity S1. Correcting quantity S1 is applied to an adding point 57 to which further the correcting quantities of the regulating units corresponding to the other cylinders are connected. The output signal of adding point 57 is applied to a device 56 for forming a mean value. The output signal of mean-value device 56 is connected to a connecting node 55.

All the regulating units corresponding to the individual cylinders are connected to this node 55 as shown, for example, with reference to regulating unit 11 where connecting node 55 is connected to subtracting point 53. Because the mean value of the correcting quantities of the regulating units corresponding to the individual cylinders is thus fed back to the output signals of the integrators of these regulating units, a purely dynamic action of the smooth-running regulating arrangement is achieved, that is, the correcting signal S is equal to zero over z combustions.

With the smooth-running regulating arrangement described, vibrations of the vehicle are to be avoided only in the lower engine speed range, particularly at idling. This is accomplished by arranging for the smooth-running regulation to become effective only within a specific speed range. The transition areas between the range in which the smooth-running regulation is active and the speeds at which it is inactive may be covered, for example, by means of a control of the smooth-running regulating arrangement. In addition, it is also possible to assign in the transition areas a factor lying between 0 and 1 to the output signal of the smooth-running regulating arrangement, which prevents an abrupt rise or fall of the output quantity of the smooth-running regulating arrangement. With the controlled smooth-running regulating arrangement in operation, its output quantity is further multiplied by a factor which lies between 0 and 1 and is dependent on the fuel quantity, in order to achieve a smooth increase of the correcting quantity proportional to the fuel quantity in the event of a sharp drop in engine speed.

Figure 6:
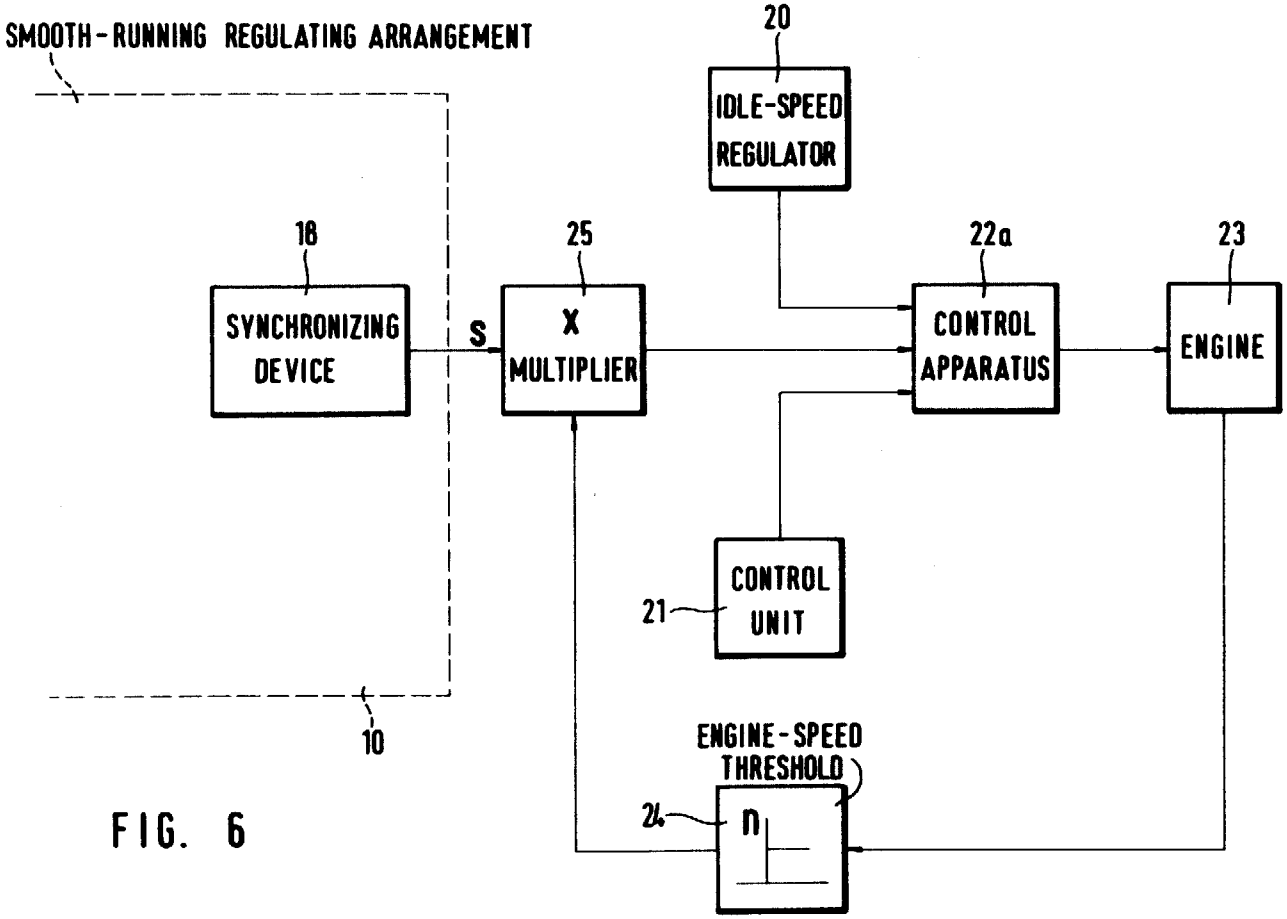

This is shown in the block diagram of FIG. 6 wherein the blocks which correspond to those of FIG. 1 are identified with like reference numerals. Block 25 is a muliplier for multiplying the correcting signal S by a factor k in the range $0 \leqq k \leqq 1$ depending on the engine speed. Block 24 is the threshold for engine speed.

In the smooth-running regulating arrangement described, the actual-value signal, that is, the duration of time between two combustions, was determined by means of the segmented wheel. It is also possible to generate a speed signal by means of a fast tachometer generator or by means of a toothed wheel with a pulse generator and frequency voltage converter connected in series therewith. An actual-value signal for the smooth-running regulating arrangement can be generated by integration of this speed signal from injection to injection or from synchronizing pulse to synchronizing pulse. Still another possibility for generation of the actual-value signal would be to make an evaluation of the peak value of the speed signal between two injection quantities.

In the smooth-running regulating arrangement described, the combustion time points necessary for providing the actual-value signal are determined by subdividing the time period between two combustions into two time portions. Since it may be desirable to have the transfer of the actual-value signal to the memory storage units and/or the transfer of the correcting quantities to the fuel-metering apparatus not occur at precisely one combustion time point, it is possible to extend the smooth-running regulating arrangement described by means of a counter such that the counter is reset by a reference signal, for example, by a needle-stroke pulse, a pulse indicative of the commencement of injection or a pulse indicative of the commencement of combustion, et cetera, and drives the two synchronizing devices at specific predeterminable counter readings. It is thereby possible to activate the two synchronizing devices at any, yet specific, moments of time. The counter may then count up in dependence on engine speed and deliver the synchronizing pulses to the two synchronizing devices at specific counter readings, or it counts up at a fixed frequency and determines the synchronizing time points in dependence on engine speed. It is also possible for the counter to be reset on each synchronizing pulse and on each reference pulse.

In the smooth-running regulating arrangement described, the four segments of the wheel were evenly spaced over the wheel periphery. By means of these segments, the time between two combustions was subdivided into a short time duration and a long time duration. For a better distinction between the short and long time durations, the wheel segments may be of asymmetrical configuration. In the case of the smooth-running regulating arrangement described with reference to a four-cylinder internal combustion engine, this would mean that only two opposite segments are of the same length. This asymmetrical configuration has no influence on the determination of the actual-value signal I because the actual-value signal I represents the time period between two combustions which covers two segments.

Under normal operating conditions, the segmented wheel subdivides the time between two combustions into a short time duration and a long time duration. The case may now occur that noise signals of a frequency lower than the injection frequency are superimposed upon these time periods. An even alternation of short and long time durations is thus no longer warranted. The synchronizing devices will then determine whether one time duration is longer than the preceding and the following one, thus performing a maximum time check. A synchronizing counter which is incremented by unity at the end of each time duration is always checked when the maximum time check has established a long time duration, for example. If the synchronizing is correct, the ends of the long time durations will always coincide with odd synchronizing counter readings, for example. If, as a result of an error function, the end of a long time duration coincides with an even number synchronizing counter reading, the synchronization is incorrect. If an incorrect synchronization is detected, a check is made to determine whether another incorrect synchronization occurs within the next 20 time durations, for example. Only if this is the case will the synchronization be changed.

Error functions may also be detected by a subtraction of the two last time durations. In dependence on the result of such a subtraction, a value is written into a shift register. A comparison of the values held in the shift register with predetermined values permits errors to be detected and suitably corrected. The size of the shift register and the predetermined values characterizing the error functions have to be determined experimentally.

In the smooth-running regulating arrangement described, the correcting signal S was supplied to the fuel-metering apparatus 22 or control apparatus 22a in a FIG. 6 which then influences the amount of fuel to be injected internal combustion engine, for example. It is to be understood that the correcting signal S may also be used to influence other control quantities of the internal combustion engine directly or indirectly, as for example, exhaust gas recirculation, start of injection, duration of injection, air/fuel ratio, ignition point, et cetera by means of control apparatus 22a in FIG. 6.

The apparatus illustrated and described in FIGS. 1 to 5 may be implemented using an analog circuit configuration, for example. It is particularly advantageous to implement the smooth-running regulating arrangement described and, where applicable, further control and/or regulating arrangements for fuel metering by means of a suitably programmed microprocessor, for example. However, when utilizing such a computer, the block diagrams illustrated may no longer be recognizable, having been replaced by subroutine structures, time-division multiplex methods, et cetera.

The smooth-running regulating arrangement described is suitable for use in internal combustion engines operating pursuant to various different operating principles, including internal combustion engines with auto ignition, with spark ignition, et cetera. In this arrangement it is particularly advantageous that, in dependence on the operating principle of the internal combustion engine, the regulating unit corresponding to each cylinder of the internal combustion engine influences several control quantities of the internal combustion engine directly or indirectly.

It is understood that the foregoing description is that of the preferred embodiments of the invention and that various changes and modifications may be made thereto without departing from the spirit and scope of the invention as defined in the appended claims.

What is claimed is:

1. An apparatus for influencing and controlling an internal combustion engine having a predetermined number of cylinders (z), the influence and control being in dependence upon the position of an accelerator pedal and a signal prepared for a specific cylinder, the apparatus comprising:

a segment system for generating actual-valve signals ($I_1$ to $I_z$) indicative of the time elapsing between each two successive combustions over a crank angle of 720°;

mean-value means receiving said signals ($I_1$ to $I_z$) for forming the means value ($M_z$) thereof; and, an arrangement for forming a cylinder specific rotational speed signal (S) from said actual-value signals and said mean value ($M_z$), the arrangement including:

a plurality of proportional-integral regulating units corresponding to respective ones of said cylinders for forming respective correcting signals ($S_1$ to $S_z$) from respective ones of said actual-value signals ($I_1$ to $I_z$) and said mean value ($M_z$); and, synchronization means for making ready the corrective signal for cylinder (n+1) in which the next combustion will occur at the time combustion occurs in cylinder (n).

2. The apparatus of claim 1, comprising a plurality of memory storage units corresponding to respective ones of said regulating units, each one of said memory storage units buffering the last actual-value signal intended for the regulating unit corresponding thereto.

3. The apparatus of claim 2, said mean-value means being connected to the outputs of said memory storage units for forming said mean-value signal from said actual-value signals buffered therein.

4. The apparatus of claim 3, second synchronization means for forming a correction signal from an actual-value signal of the actual value corresponding to each regulating unit and from a correcting quantity formed from the regulating units.

5. The apparatus of claim 4, the synchronizations in said synchronization means being dependent on the points of time of combustion in the individual cylinders of the internal combustion engine.

6. The apparatus of claim 5, comprising monitor means for monitoring said synchronizations and, after two incorrect synchronizations within a presupposed definite time, for changing the subsequent synchronizations.

7. The apparatus of claim 4, said actual-value signal being a signal dependent on the smooth-running of the internal combustion engine and said correction signal being a signal influencing the combustion of the internal combustion engine.

8. The apparatus of claim 7, comprising: means for detecting the smooth-running of the internal combustion engine with the aid of the time points of the combustions in the individual cylinders of the internal combustion engine; and, means for influencing the combustion of the internal combustion engine with aid of at least one of the following: metered fuel, exhaust gas feedback, fuel injection time point, length of time for injection, the fuel/air ratio and ignition time point.

9. The apparatus of claim 8 said means for detecting the smooth-running of the internal combustion engine including means for detecting the time between two combustion time points of the individual cylinders of the engine, said time between two combustion time points being used as a measure of the smooth running of the engine.

10. The apparatus of claim 1, comprising: segmented wheel means operatively connected to the crankshaft of the internal combustion engine, said wheel means including: a plurality of symmetrical segments; time measuring means for measuring the time required for each one of said segments to pass through an imaginary plane perpendicular to said segmented wheel means and for subdividing the time between each two successive combustions of the engine into two time durations and for providing signals for said synchronization means indicative of said time durations, respectively, said signals being characteristic of the smooth-running of the engine and the one of said signals immediately following a combustion being of shorter duration than the other one of the signals immediately preceding the next one of the combustions.

11. The apparatus of claim 10, said segments of said segmented wheel means being alternately longer and shorter whereby the point of time of a combustion is determined with still greater accuracy.

12. The apparatus of claim 11, comprising means for detecting the smallest time difference between two combustion time points and for utilizing said difference as a measure of the smooth-running of the internal combustion engine.

13. Apparatus for influencing control quantities of an internal combustion engine having a plurality of cylinders, the apparatus comprising:

a plurality of regulating units for corresponding ones of said cylinders;

synchronization means for generating actual-value signals indicative of the respective time spans between successive combustions;

mean-value means for generating a mean-value signal from said actual-value signals;

each of asid regulating units including means for forming a correcting value for the cylinder corresponding thereto from an actual-value signal and from said mean-value signal; and, said apparatus being effective only in a definite, presupposable rotational engine speed range and being controlled in the transition ranges bounding on said range so as to avoid a jump-like climb or drop of the correcting signal.

* * * * *

UNITED STATES PATENT AND TRADEMARK OFFICE

CERTIFICATE OF CORRECTION

PATENT NO. : 4,688,535

DATED : August 25, 1987

INVENTOR(S) : Thomas Küttner, Wolf Wessel

It is certified that error appears in the above-identified patent and that said Letters Patent is hereby corrected as shown below:

In column 1, line 50: delete "appartus" and substitute -- apparatus -- therefor.

In column 7, line 26: after the word "injected" insert -- into the --.

In column 7, line 67: delete "actual-valve" and substitute -- actual-value -- therefor.

In column 8, line 4: delete "means" and substitute -- mean -- therefor.

UNITED STATES PATENT AND TRADEMARK OFFICE

CERTIFICATE OF CORRECTION

PATENT NO. : 4,688,535

DATED : August 25, 1987

INVENTOR(S) : Thomas Küttner, Wolf Wessel

It is certified that error appears in the above-identified patent and that said Letters Patent is hereby corrected as shown below:

In column 8, line 55: insert a comma after the number "8".

In column 8, line 62: after "claim 1," insert -- said segment system --.

In column 10, line 11: delete "asid" and substitute -- said -- therefor.

Signed and Sealed this

Fourteenth Day of June, 1988

*Attest:*

*Attesting Officer*

DONALD J. QUIGG

*Commissioner of Patents and Trademarks*